US006860413B2

(12) United States Patent
Hunter

(10) Patent No.: US 6,860,413 B2
(45) Date of Patent: Mar. 1, 2005

(54) SHAVING CREAM DISPENSER

(76) Inventor: Lancelot Hunter, 94 Spyglass Cir., Groton, CT (US) 06340

( * ) Notice: Subject to any disclaimer, the term of this patent is extended or adjusted under 35 U.S.C. 154(b) by 0 days.

(21) Appl. No.: 10/413,756

(22) Filed: Apr. 15, 2003

(65) Prior Publication Data

US 2003/0218028 A1 Nov. 27, 2003

Related U.S. Application Data

(60) Provisional application No. 60/372,993, filed on Apr. 16, 2002.

(51) Int. Cl.[7] ..... B67D 5/64

(52) U.S. Cl. ..... 222/463; 220/560; 222/402.1

(58) Field of Search ..... 222/463, 402.1; 220/560

(56) References Cited

U.S. PATENT DOCUMENTS

| | | | | | |
|---|---|---|---|---|---|
| 2,913,153 | A | * | 11/1959 | Hester, Jr. | 222/463 |
| 3,618,810 | A | * | 11/1971 | Wilson | 220/560 |
| 5,096,095 | A | * | 3/1992 | Burton | 222/173 |
| 5,312,257 | A | * | 5/1994 | Tarvin et al. | 434/219 |
| 5,964,369 | A | * | 10/1999 | Greene et al. | 220/560 |
| 6,244,066 | B1 | * | 6/2001 | LaRose | 220/560 |

* cited by examiner

*Primary Examiner*—Philippe Derakshani
(74) *Attorney, Agent, or Firm*—Fliesler Meyer LLP

(57) ABSTRACT

A shaving cream dispenser with a weighted bottom and/or an air space in its upper section allowing for upright flotation in water. The dispenser can also be colored red on its top section and white on its bottom section to resemble a fishing bobber.

9 Claims, 2 Drawing Sheets

SHAVING CREAM DISPENSER

RELATED APPLICATION

This application claims priority under 35 U.S.C. §119 to U.S. Provisional Patent Application Ser. No. 60/372,993, filed Apr. 16, 2002, and is incorporated herein fully by reference.

FIELD OF INVENTION

This invention relates to a dispenser for shaving cream. More specifically the invention relates to a shaving cream dispenser that is weighted at the bottom, enabling the dispenser to float in water and maintain a convenient position for use. Additionally, the dispenser may be colored red on one portion and white on the opposit portion, increasing the visibility of the dispenser while in use. The dispenser can also have a protective coating or be made of corrosion resistant material to prevent rusting of the dispenser with water contact.

BACKGROUND

Shaving cream is available in a pressurized can or as a compound that is mixed with water to form a thick, soapy lather. Shaving cream enables the razor to cut hair more closely to the skin and provides protection to the skin during shaving. Comfort and a close shave are also enhanced by using warmed water and warmed shaving cream.

Mixing lather at the time of shaving is more time consuming and requires the use of additional utensils such as a cup to mix the shaving cream in and a brush for mixing the shaving cream and applying the lather. Pressurized cans are available that dispense the shaving cream as a lather. Using shaving cream from a pressurized can is more convenient as the lather is instantly provided without the time and effort for mixing or any additional utensils. Because shaving involves the use of water, the pressurized cans are often exposed to water and can rust or corrode. The rusted or corroded can then leaves stains wherever is placed. It is desirable to have a shaving cream dispenser that would contain pre mixed lather and be capable of floating in heated water to heat the shaving cream inside the dispenser.

SUMMARY

Accordingly, the present invention cures and addresses the disadvantages exhibited in the prior art. What is desired is to provide a shaving cream dispenser that floats in heated water, thereby dispensing warm shaving cream for comfortable and close shaving. It is further desired that the dispenser be made of a non corrosive material or coated to prevent corrosion. An additional aspect of the invention is a color scheme that enhances visibility of the shaving cream dispenser. The present invention cures and addresses the disadvantages exhibited in the prior art. Further aspects, objects, advantages and embodiments of the invention can be understood from the specification, figures and claims.

DETAILED DESCRIPTION

This invention consists of improvements to products already available. The invention comprises a shaving cream vessel designed to be warmed in water, thereby allowing the consumer to enjoy a warm lather shave. Further, it is decorated to resemble a fishing bobber. A fishing bobber is a device that attaches to a fishing line and is painted in such a way as to be easy to see so as to alarm fisherman by bobbing up and down in the water when a fish is caught on their line. While shaving the face, a user is often looking in a mirror positioned above a sink with lather on their face, making it difficult to focus on a dispenser floating in the sink. Brightly colored markings on the shaving cream dispenser of the present invention are a useful feature in that they enhance the visibility of the dispenser as it is being used during shaving. Typical color combinations for the shaving cream dispenser may include red, white, neon yellow, electric blue, neon pink, neon green or orange. The description and examples of embodiments herein of colors, color combinations or the number of colors used or the pattern of the coloring scheme on the shaving cream dispenser are not intended to limit the present invention. Any colors or combinations thereof that serve to enhance the visibility of the shaving cream dispenser while shaving may be used.

One feature of this new design is a corrosion resistant coating to reduce rusting and staining of surfaces due to loose rust on the bottom of the can. The product could be un-coated if made of a non-corrosive material. Another feature is a weight and/or an air gap integrated into the vessel structure that promotes flotation in a convenient position. For example, the present invention can be designed to float upright or on its side. The walls of the dispenser promote heat transfer to the contents of the vessel, providing a shortened warm up period. The dispenser can be designed to withstand household water temperatures under normal use.

Figure 1:
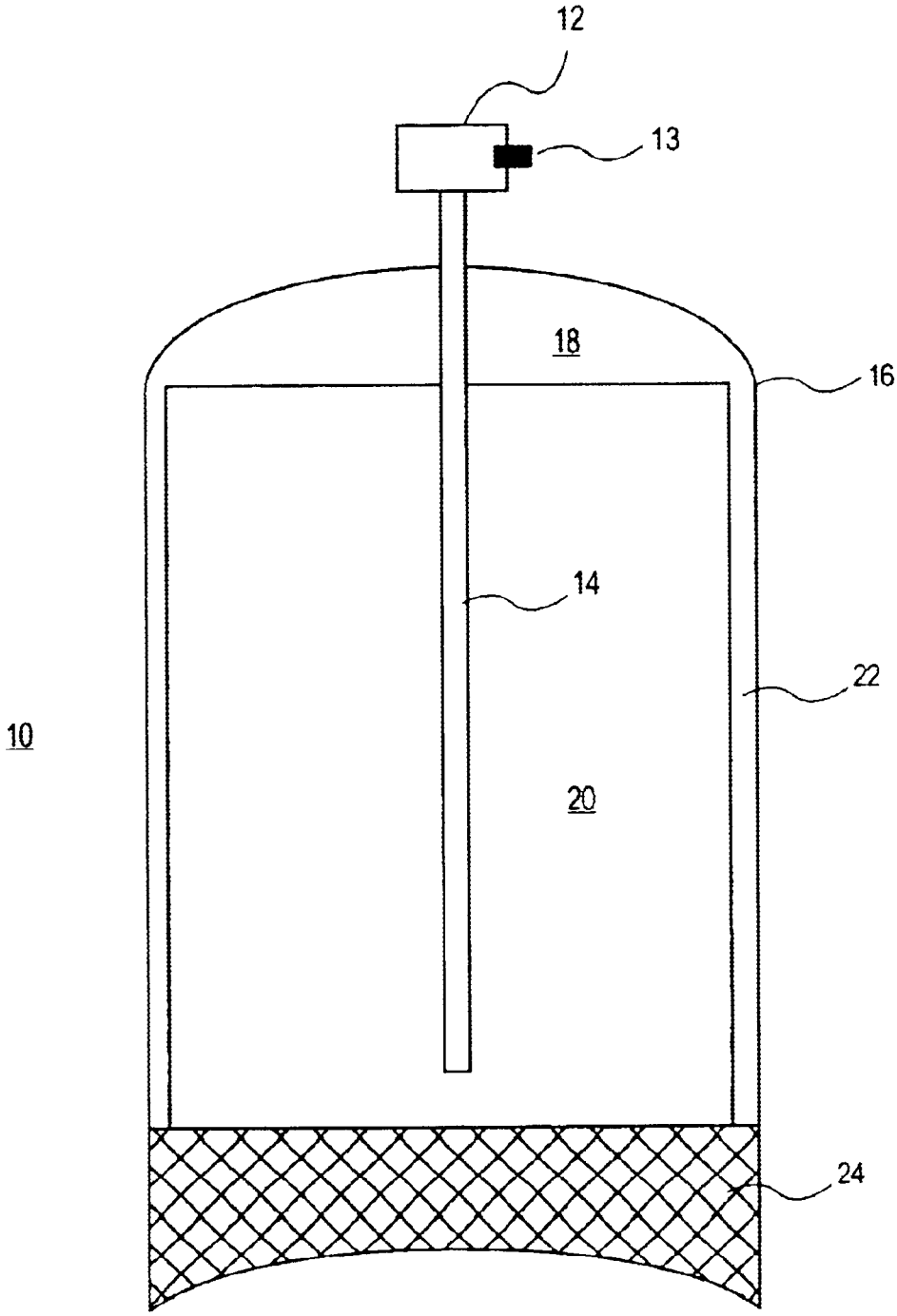
FIG. 1 is an embodiment of the invention shown in cross section.

In FIG. 1, the dispenser 10 is shown with a cross sectional view. The dispenser has a nozzle 12 connected to a tube 14, such that when the nozzle is depressed, the contents of the dispenser 10 travel up the tube 14 and are delivered outside the dispenser 10 via the opening 13 in the nozzle 12. The exterior 16 of the dispenser 10 can be made of a non-corrosive material or coated to prevent corrosion. The exterior 16 also can be composed of a material that allows for rapid heat transfer to the interior, allowing for rapid heating of the shaving cream. The top portion of the dispenser 10 may have an air space 18 to facilitate proper floatation of the dispenser 10 in heated water. The interior of the dispenser 10 has a cavity 20 suitable for holding shaving cream. The walls of the dispenser may also have a space 22 for air to aid in flotation. In the preferred embodiment, the dispenser 10 has a weighted bottom 24 that allows the dispenser 10 to float in the upright position. Alternatively, the weighting of the dispenser maybe such that the dispenser floats on its side or in any other position best for convenient dispensing of shaving cream by the user.

Figure 2A:
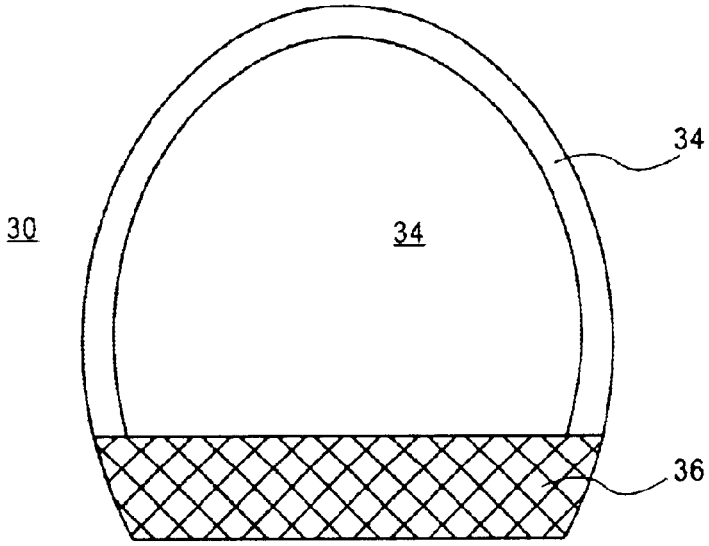
FIG. 2A is another embodiment of the invention shown in cross section.

Another embodiment of the invention is FIG. 2A, depicting a cross sectional view. The dispenser 30 can be more rounded in shape, resembling more closely a fishing bobber. The walls of the dispenser 30 may have an air space 32 to facilitate proper flotation. The interior 34 of the dispenser 30 is suitable for holding shaving cream. Additionally the dispenser 30 may have a weighted bottom 36 to enable flotation in a position most convenient for use. The position of the weight at the bottom of the dispenser may be located inside or attached to the outside of the dispenser.

Figure 2B:
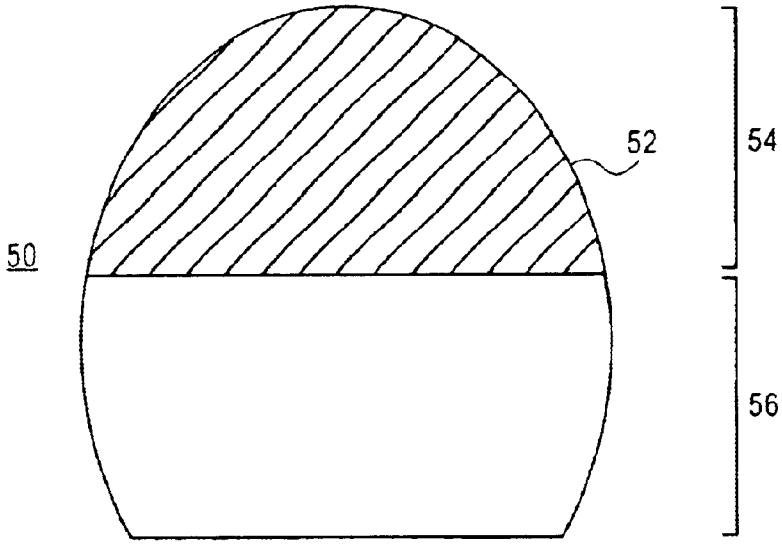
FIG. 2B is an embodiment of the invention viewed from the side.

FIG. 2B shows the dispenser 50 of FIG. 2A from a side view, without cross section. Similar to FIG. 2A, the dispenser 50 may be rounded in shape. The exterior walls 52 may be made of non-corrosive metal or coated to prevent corrosion. The dispenser 50 has a top section 54 and a bottom section 56. The top section 54 may be colored differently than the bottom section 56 to simulate the appearance of a fishing bobber, but the coloring scheme of the present invention is not so limited.

The foregoing description of the preferred embodiments of the present invention has been provided for the purposes of illustration and description. It is not intended to be exhaustive or to limit the invention to the precise forms disclosed. Many modifications and variations will be apparent to the practitioner skilled in the art. Embodiments were chosen and described in order to best describe the principles of the invention and its practical application, thereby enabling others skilled in the art to understand the invention, the various embodiments and with various modifications that are suited to the particular use contemplated. It is intended that the scope of the invention be defined by the following claims and their equivalents.

What is claimed is:

1. A shaving cream dispenser comprising:

a sealed vessel with a top portion and a bottom portion;

a nozzle;

said nozzle joined to said sealed vessel with said nozzle adapted to dispense as a foam the contents of said sealed vessel;

an airspace within said vessel to provide buoyancy;

a pressure source within said vessel; and a weight in the bottom of said sealed vessel.

2. The dispenser of claim 1 wherein:

said sealed vessel has a color scheme adapted to enhance the visibility of the dispenser while shaving.

3. The dispenser of claim 1 wherein:

said sealed vessel is colored red on one of either the top portion of the vessel or the bottom portion of the vessel and white on the other.

4. The dispenser of claim 1 wherein:

said weight allows the sealed vessel to float in water in the best position for convenient dispensing.

5. The dispenser of claim 1 wherein:

the sealed vessel is coated with a water proof coating that prevents corrosion of the vessel upon repeated exposure to water.

6. The dispenser of claim 1 wherein:

the sealed vessel is composed of a non-corrosive material.

7. The shaving cream dispenser of claim 1 wherein:

said dispenser is spheroid in shape.

8. The shaving cream dispenser of claim 1 wherein:

the top portion of the sealed vessel has an airspace adapted to cause the sealed vessel to float the best position for convenient dispensing.

9. The shaving cream dispenser of claim 8 wherein:

said air space extends into the walls of the dispenser.

* * * * *